US009739583B2

(12) United States Patent
Kerns et al.

(10) Patent No.: US 9,739,583 B2
(45) Date of Patent: Aug. 22, 2017

(54) FRAGMENTATION MUNITION WITH LIMITED EXPLOSIVE FORCE

(71) Applicant: Raytheon Company, Waltham, MA (US)

(72) Inventors: Keith A Kerns, Tucson, AZ (US); John J Spilotro, Tucson, AZ (US); Brandon J Cundiff, Oro Valley, AZ (US); Thomas H Bootes, Tucson, AZ (US); Jason M Shire, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 259 days.

(21) Appl. No.: 14/453,991

(22) Filed: Aug. 7, 2014

(65) Prior Publication Data

US 2016/0231096 A1 Aug. 11, 2016

(51) Int. Cl.
*F42B 12/32* (2006.01)
*F42B 12/20* (2006.01)

(52) U.S. Cl.
CPC ..... *F42B 12/32* (2013.01); *F42B 12/204* (2013.01); *F42B 12/207* (2013.01)

(58) Field of Classification Search
CPC ..... F42B 12/745; F42B 12/74; F42B 12/30; F42B 12/204–12/208; F42B 12/202;
(Continued)

(56) References Cited

U.S. PATENT DOCUMENTS 3,518,942 A * 7/1970 Philipchuk ..... F42B 12/22 102/473
3,981,243 A 9/1976 Doris, Jr.
(Continued)

FOREIGN PATENT DOCUMENTS

CH 649627 A5 5/1985
DE 2557676 A1 6/1977
(Continued)

OTHER PUBLICATIONS

International Search Report and Written Opinion from corresponding International Application No. PCT/US2015/023873, mailed on Dec. 22, 2015.

*Primary Examiner* — John D Cooper
(74) *Attorney, Agent, or Firm* — Renner, Otto, Boisselle & Sklar, LLP

(57) ABSTRACT

A fragmentation munition has a fragmentation canister containing preformed fragments, and an explosive cartridge that fits into a central hole in the fragmentation canister. The explosive cartridge includes an outer shell, and an explosive within the outer shell. The munition may be configured to precisely deliver fragments to a relatively small area, such as an area that is a few meters in radius. Toward that end the explosive may be configured primarily to rupture the housing and secondarily to spread fragments over a limited area. The main kinetic energy of the fragments is from the acceleration they gain as part of the munition falls from a launcher, such as a carrier aircraft. The dispersed fragments may have a similar downward velocity after controlled dispersal by the explosive, allowing them considerable kinetic energy (considerable penetrating power), but with a precisely controlled dispersal area.

14 Claims, 8 Drawing Sheets

(58) Field of Classification Search
CPC ..... F42B 12/20; F42B 12/02; F42B 12/00; F42B 12/32; F42B 3/02; F42B 3/08; F42B 3/22; F42B 3/24; F42B 3/30
USPC ..... 102/491–497
See application file for complete search history.

(56) References Cited

U.S. PATENT DOCUMENTS

| | | | | |
|---|---|---|---|---|
| 4,592,283 | A | 6/1986 | Hellner et al. | |
| 4,648,323 | A * | 3/1987 | Lawther | F42B 12/32 102/495 |
| 4,664,035 | A * | 5/1987 | Osofsky | F42B 12/22 102/493 |
| 4,781,117 | A * | 11/1988 | Garnett | F42B 12/76 102/374 |
| 4,848,239 | A * | 7/1989 | Wilhelm | F42B 12/22 102/475 |
| 5,117,759 | A * | 6/1992 | Henderson | F42B 12/32 102/473 |
| 5,131,329 | A | 7/1992 | Lips et al. | |
| 5,305,505 | A | 4/1994 | Ruhlman | |
| 5,341,638 | A * | 8/1994 | Van Name | B29C 70/865 156/172 |
| 5,535,679 | A | 7/1996 | Craddock | |
| 5,939,662 | A | 8/1999 | Bootes et al. | |
| 6,105,505 | A | 8/2000 | Jones | |
| 6,186,072 | B1 | 2/2001 | Hickerson, Jr. et al. | |
| 6,374,744 | B1 | 4/2002 | Schmaker et al. | |
| 6,484,642 | B1 * | 11/2002 | Kuhns | F42B 12/24 102/493 |
| 6,601,517 | B1 | 8/2003 | Guirguis | |
| 6,619,210 | B1 | 9/2003 | Spivak et al. | |
| 6,659,013 | B1 | 12/2003 | Kellner | |
| 7,506,587 | B1 * | 3/2009 | Anderson | F42B 10/40 102/473 |
| 7,614,348 | B2 | 11/2009 | Truitt et al. | |
| 8,061,275 | B1 | 11/2011 | Gold | |
| 8,119,956 | B2 * | 2/2012 | Janik | F41G 7/32 102/473 |
| 8,191,479 | B2 | 6/2012 | Ruhlman et al. | |
| 8,234,979 | B1 | 8/2012 | Falabella et al. | |
| 8,671,840 | B2 | 3/2014 | Scheid et al. | |
| 8,701,557 | B2 | 4/2014 | Biggs et al. | |
| 2003/0167956 | A1 * | 9/2003 | Kellner | F42B 12/204 102/517 |
| 2005/0115450 | A1 | 6/2005 | Lloyd | |
| 2010/0199875 | A1 * | 8/2010 | Weihrauch | F42B 12/208 102/492 |
| 2012/0227609 | A1 | 9/2012 | Volkmann | |
| 2012/0291651 | A1 | 11/2012 | Haumann et al. | |

FOREIGN PATENT DOCUMENTS

| | | | | |
|---|---|---|---|---|
| EP | 1001244 | A1 | 5/2000 | |
| EP | 1316774 | A1 | 6/2003 | |
| EP | 1367358 | A2 | 12/2003 | |
| EP | 1864960 | A2 | 12/2007 | |
| EP | 2095059 | B1 | 9/2009 | |
| FR | 2910612 | A1 | 6/2008 | |
| GB | 2384291 | A | 7/2003 | |
| WO | 9830863 | A1 | 7/1998 | |
| WO | WO 2008073540 | A2 * | 6/2008 | F24B 12/32 |
| WO | 2008089078 | A2 | 7/2008 | |
| WO | 2009102254 | A1 | 8/2009 | |
| WO | 2011054361 | A1 | 5/2011 | |
| WO | 2015175036 | A2 | 11/2015 | |
| WO | 2015175037 | A2 | 11/2015 | |
| WO | 2015175038 | A2 | 11/2015 | |
| WO | 2015175039 | A2 | 11/2015 | |
| WO | 2015175040 | A2 | 11/2015 | |
| WO | 2016022181 | A1 | 2/2016 | |
| WO | 2016022199 | A1 | 2/2016 | |

* cited by examiner

FRAGMENTATION MUNITION WITH LIMITED EXPLOSIVE FORCE

FIELD OF THE INVENTION

The invention relates generally to munitions, such as bombs or missiles, and specifically to fragmentation munitions.

DESCRIPTION OF THE RELATED ART

There is a general need for fragmentation munitions that target areas, and that introduce multiple fragments or projectiles into a target area. It is desirable that fragments cover as large an area as desired, with a desired dispersal within that target area, and without the fragments extending beyond the target area.

In addition, difficulties in the storage, transportation, and deactivation of fragmentation munitions occur due to the presence of explosives in such munitions

SUMMARY OF THE INVENTION

A fragmentation munition uses a relatively small explosive to spread fragments over a small controlled area, relying mainly on acceleration of the munition from gravity to produce kinetic energy in the fragments.

A munition includes a canister that houses fragments, and an explosive cartridge that fits into the canister, wherein the canister and the explosive cartridge are modular, being capable of being separated and separately handled.

A munition has preformed fragments, and an explosive that may be detonated to disperse the fragments. The explosive may vary in explosive force along an axial direction in the length of the munition, varying the amount of dispersion of the fragments, with fragments subject to greater explosive force being dispersed farther from the detonation than fragments subject to lesser explosive force.

According to an aspect of the invention, a fragmentation munition includes: a fragmentation canister containing preformed fragments; and an explosive in a central hole in the fragmentation canister. A weight ratio of the fragments to the explosive is from 15:1 to 100:1.

The explosive may be part of a removable explosive cartridge inserted in the central hole; wherein the explosive cartridge includes: an outer shell; and the explosive within the outer shell.

According to another aspect of the invention, a fragmentation munition includes: a fragmentation canister containing preformed fragments; and a removable explosive cartridge inserted in a central hole in the fragmentation canister. The explosive cartridge may include: an outer shell; and an explosive within the outer shell.

The central hole may have a shape corresponding to a shape of the explosive cartridge.

The explosive cartridge may have a cylindrical shape, with a substantially-constant diameter over at least part of an axial length of the cartridge.

The explosive cartridge may have a relatively small diameter at a first end of the cartridge that is first inserted into the central hole, and a relatively large diameter, larger than the relatively small diameter, at a second end of the cartridge that is opposite the first end The explosive cartridge may have a tapered shaped, tapering from the relatively small diameter to the relatively large diameter.

The explosive may also have a tapered shape that changes diameter with changes in axial location.

The cartridge may include a conduit running axially through the explosive.

The conduit may be in communication with an aligned conduit that is part of the canister.

The conduit may be in communication a radial conduit hole through the explosive and the outer shell.

The radial conduit hole may be aligned with a radial canister hole through the canister.

The explosive may be a high explosive.

The explosive may make up a majority of the volume of the cartridge.

Explosive force of the explosive may vary with axial location along the explosive cartridge.

Variation in the explosive force may be due at least in part to variations in amount of the explosive at different axial locations.

Variation in the explosive force may be due at least in part to variations in composition of the explosive at different axial locations.

Upon detonation of the explosive, different fragments may be dispersed different distances from the munition, with fragments subject to relatively large explosive force being dispersed farther than fragments subject to relatively small explosive force that is less than the relatively large explosive force.

The cartridge may include an integral fuzewell at one end of the cartridge.

The munition may further include a fuze in the fuzewell, wherein the fuze is operatively coupled to the explosive to trigger detonation of the explosive.

The cartridge may include a mounting bracket at one end of the cartridge.

The mounting bracket may include an array of holes that corresponding to mounting holes on the canister, for receiving fasteners for mounting the cartridge to the canister.

The array of holes may compel a desired alignment between the cartridge and the canister, when the cartridge and the canister are coupled together.

The canister may include a casing that contains the fragments.

The munition may further include an airframe that surrounds the canister and the cartridge.

The airframe may be a clamshell airframe.

The munition may be in combination with a nose kit that is coupled to a forward end of the munition.

The nose kit may be operatively coupled to a fuze in a fuzewell of the cartridge, to trigger the fuze to thereby detonate the explosive.

The munition may be in combination with a tail kit that is coupled to an aft end of the munition.

According to yet another aspect of the invention, a method of using a fragmentation munition includes the steps of: accelerating the fragmentation munition toward the ground; and after the accelerating, detonating the fragmentation munition at a height above the ground, to disperse fragments of the munition prior to the fragments impacting a target area. The detonation includes detonating an explosive in a central hole of a fragmentation canister of the munition that contains the fragments. The detonation disperses the fragments to a radius of 15 meters or less when impacting the target area.

The height at which the detonation occurs may be varied to vary the radius at which the fragments are dispersed when impacting the target area.

The method may also include, prior to releasing the munition from a launcher, selecting the height.

The detonating may includes detonating the explosive at a height of 20 meters or less.

The detonating may includes detonating the explosive at a height of 10 meters or less.

The acceleration of the munition may be primarily gravitational acceleration.

According to still another aspect of the invention, a method of handling a munition includes the steps of: separately handling a canister of the munition that contains preformed fragments, and a cartridge of the munition that contains an explosive; and coupling and/or decoupling the canister and the cartridge.

The separately handling may include transporting the canister and the cartridge while the cartridge is decoupled from the canister.

The separately handling may include storing the canister and the cartridge while the cartridge is decoupled from the canister.

The separately handling may include separately disposing of the canister and the cartridge.

The coupling and/or decoupling may include coupling and/or decoupling using fasteners that engage a bracket of the cartridge, and the canister.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A fragmentation munition has a fragmentation canister containing preformed fragments, and an explosive cartridge that fits into a central hole in the fragmentation canister. The explosive cartridge includes an outer shell, and an explosive within the outer shell. The explosive cartridge may be insertable and removable from the fragmentation canister, for example being inserted only on the flightline, just before deployment and use of the munition. The removal of the explosive cartridge may facilitate safety in transport and/or handling of the munition, and may simplify decommissioning of the munition. The explosive cartridge may be tapered to have a frusto-conical shape, which facilitates installation and removal of the explosive cartridge. Alternatively or in addition the explosive cartridge may have an explosive force that varies along an axial direction of the cartridge. This variation in explosive force may aid in providing a more uniform spread of the fragments of the fragmentation canister, upon detonation of the explosive. The explosive cartridge may have an integral fuzewell for receiving a fuze for detonating the explosive. The munition may also include an airframe that encloses the fragmentation canister and the explosive cartridge.

The munition may be configured to precisely deliver fragments to a relatively small area, such as an area that is a few meters in radius. Toward that end the explosive may be configured primarily to rupture the outer shell, and secondarily to spread fragments over a limited area. The main kinetic energy of the fragments is from the acceleration they gain as part of the munition falls from a launcher, such as a carrier aircraft. For example, the munition may reach a velocity of 300 meters/sec (1000 feet/sec) before impact. Thus the dispersed fragments may have a similar downward velocity after controlled dispersal by the explosive, allowing them considerable kinetic energy (considerable penetrating power), but with a precisely controlled dispersal area.

Figure 1:
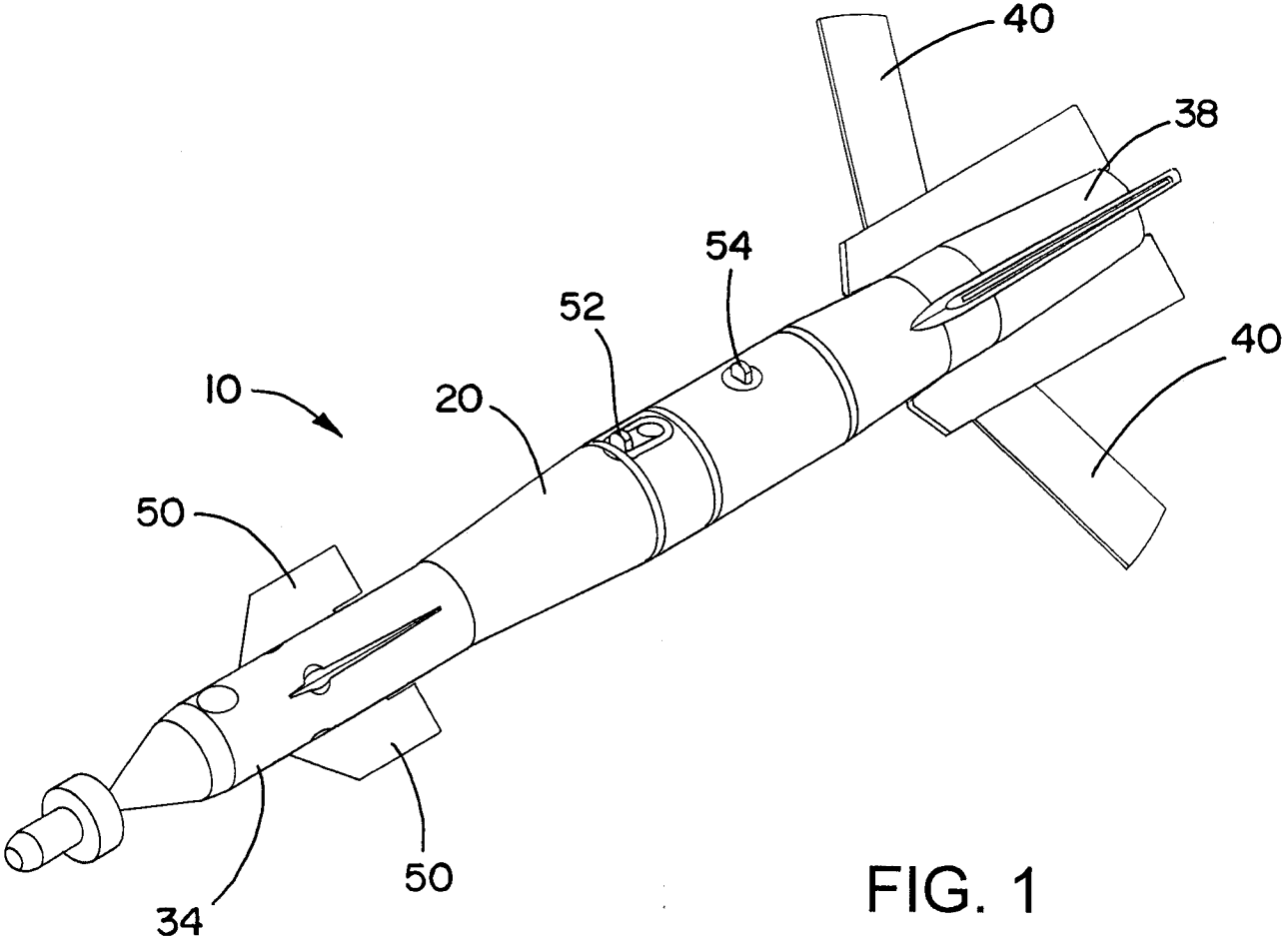
FIG. 1 is an oblique view of a munition according to an embodiment of the present invention.
Figure 2:
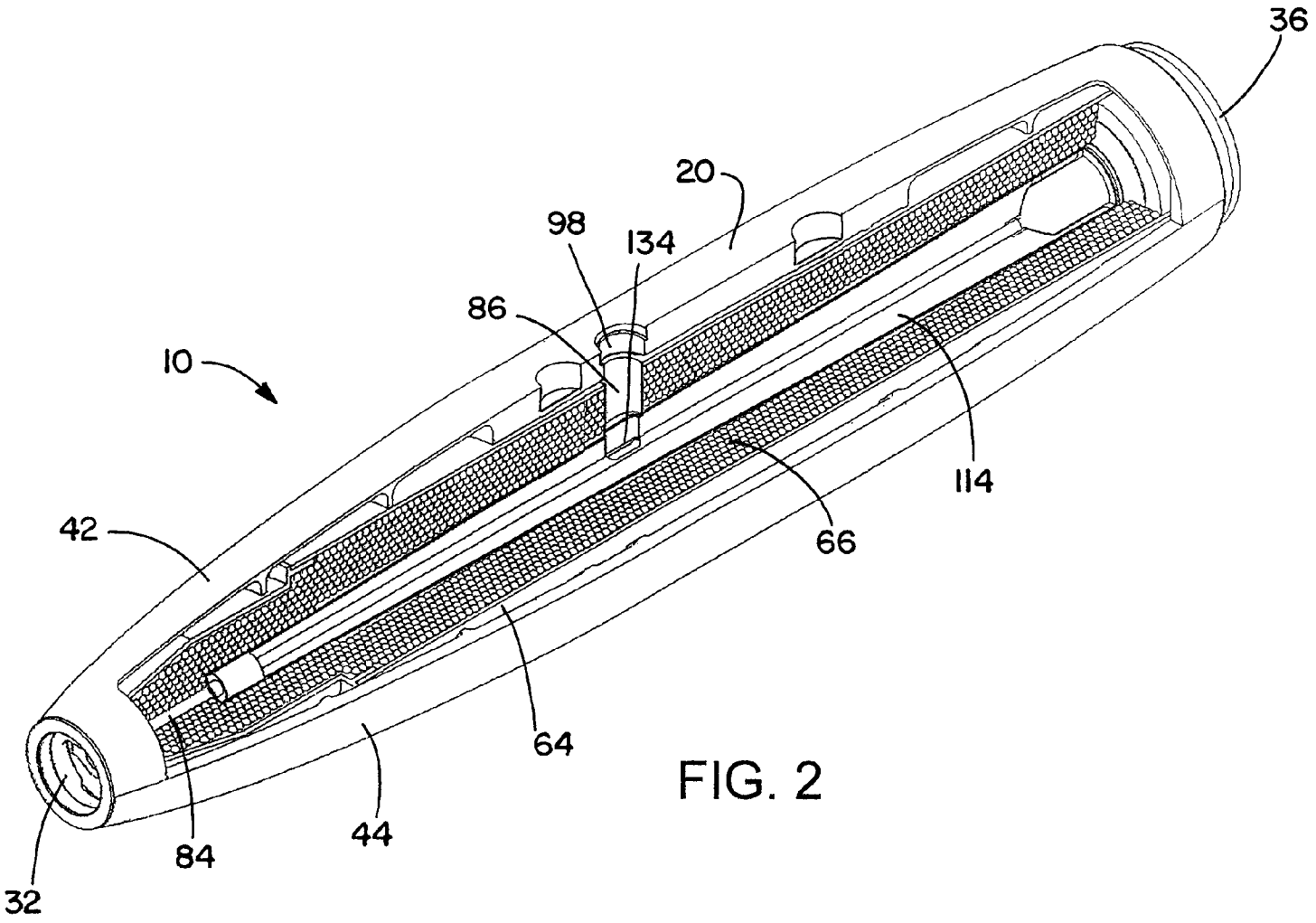
FIG. 2 is a partial sectional view of the munition of FIG. 1.
Figure 3:
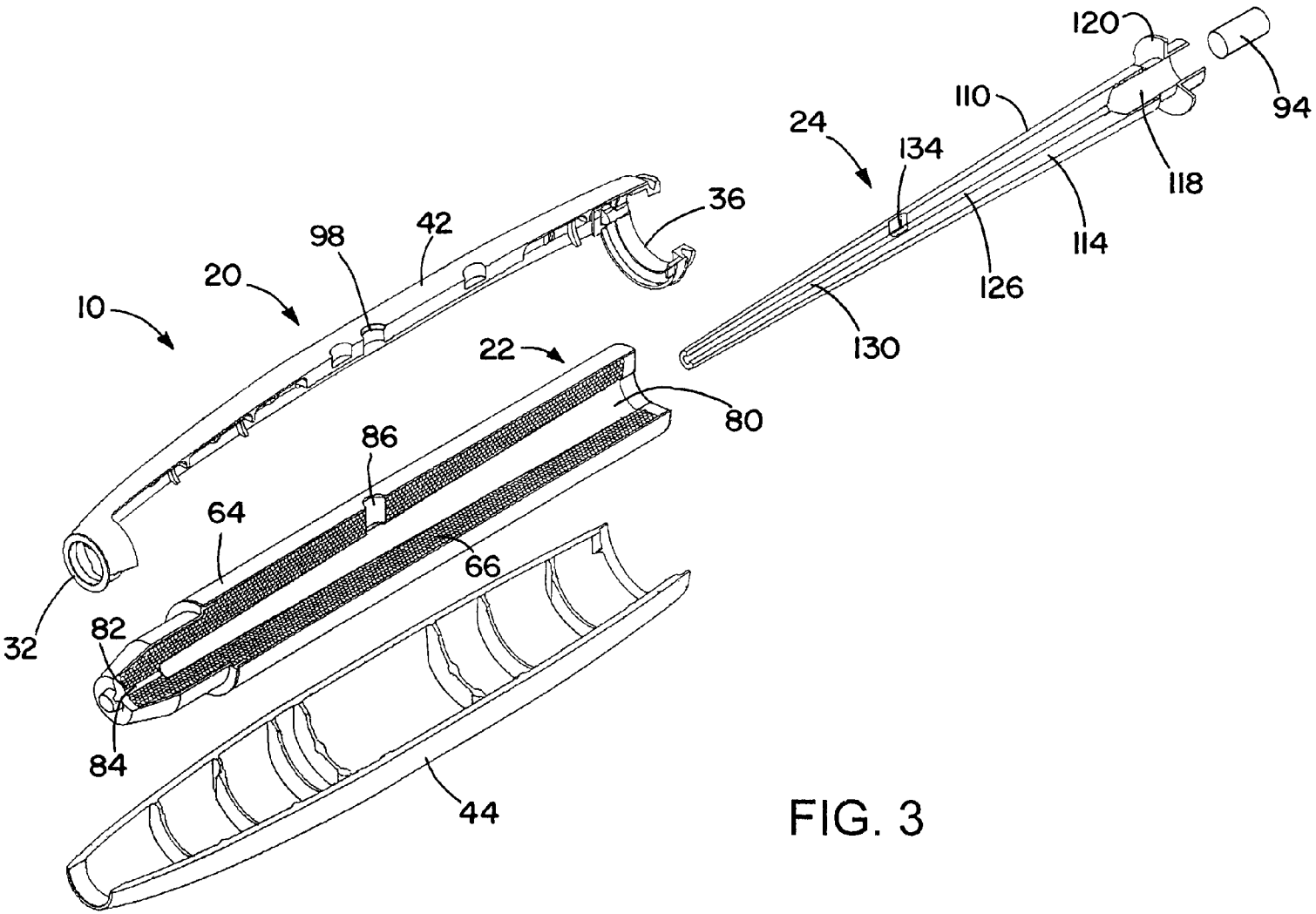
FIG. 3 is an exploded view, with some parts in cross-section, of the munition of FIG. 1.

FIGS. 1-3 show a fragmentation munition 10 that includes a clamshell airframe 20 that encloses a fragmentation canister 22, which in turn receives an explosive cartridge 24. The clamshell airframe 20 includes a forward connection (bulkhead fitting) 32 for receiving a guidance nose kit 34 (for example), and an aft connection 36 for receiving (for example) a tail kit 38 with fins 40. The airframe 20 may be configured for using a standard weapons mount on a launch platform that is also able to receive other types of weapons. The connections 32 and 36 may be standard connections that are similar to those used for other munitions, thus enabling use of standard nose and tail kits that may be used with other sorts of munitions. The airframe 20 may be in the form of a pair of clamshell halves 42 and 44, which may be made of a relatively lightweight material, such as aluminum.

The airframe 20 may be configured to correspond to the size, shape, weight, weight distribution, and/or profile of another type of munition, and may allow the munition 10 to be coupled to an aircraft (or other launch platform), and/or used, in a manner similar to another munition of that size, shape, weight, weight distribution, and/or profile. The illustrated embodiment shows one example configuration for the airframe 20. A wide variety of variations are possible, and the specific features of the illustrated embodiment (the clamshell halves 42 and 44, and the connections 32 and 36, for example) should not be considered as necessary essential features.

The guidance nose kit 34 may have canards 50 that are selectively moved to guide the munition 10 toward a desired target location. The nose kit 34 may include a processor or device for sending a signal to a fuze that is part of the munition 10. The nose kit 34 may also include a height-of-burst sensor for determining height above the ground. The fins 40 of the tail kit 38, which may be deployable, provide stability in flight to the munition 10. The nose kit 34 and the tail kit 38 may be parts of a standard enhancement for providing laser guidance capability for unguided munitions. Such enhancement for laser guidance is provided as part of PAVEWAY modified munitions, produced by Raytheon Company. Other types of nose kits and/or tail kits may be used in place of those in the illustrated embodiment.

A pair of lugs 52 and 54 may be used to couple the munition 10 to a launch platform, such as an aircraft. The lugs 52 and 54 may be mechanically coupled to the airframe 20, for example screwing into threaded holes 56 and 58 in the airframe 20.

The fragmentation canister 22 includes a casing 64 that encloses and contains fragments 66. The casing 64 may be made of any of a variety of suitable materials, such as a suitable metal (e.g., steel) or a composite material. The fragments 66 may include any of a variety of materials, such as steel, tungsten, aluminum, tantalum, lead, titanium, zirconium, copper, molybdenum, etc. The fragments 66 may be spheres, cubes, cylinders, flechetts, parallelepipeds, uncontrolled solidification shapes (such as used in HEVI-SHOT shotgun pellets), to give a few non-limiting examples. The fragments 66 may have any of a wide variety of suitable sizes.

The fragments 66 may be packed into the casing 64 without any additional material between the fragments 66. Alternatively, a binder or other material may be used to hold individual of the fragments 66 in place.

The canister 22 defines a central hole 80 for receiving the explosive cartridge 24. The central hole 80 may be centered on a longitudinal axis of the canister 22. The central hole 80 is in communication with a forward conduit 82 that extends to the front of the canister 22, defining a narrower canister hole 84 that is aligned with the central hole 80, along a central axis of the canister 22. The central hole 80 also may be surrounded by and defined by part of the casing 64.

The central hole 80 is also in communication with a radial canister hole 86 extending in a radial direction through the canister 22. The radial hole 86 is used for receiving an arming device for arming a fuze 94 of the munition 10. The airframe 20 has a corresponding hole 98 for allowing connection between the arming device and the aircraft or other launch platform. The holes 84, 86, and 98 also allow for other sorts communication and/or electrical connection between the munition 10 and the launch platform, for example to provide electrical power to the munition 10 prior to launch, or to provide targeting information (such as a height-of-burst for the munition 10).

The explosive cartridge 24 includes an outer shell 110 that encloses an explosive 114. The outer shell 110 may be made of steel or another suitable material. The explosive 114 may be any of a variety of suitable explosives, such as suitable high explosives. Non-limiting examples of suitable explosives include PBXN-109, PBXN-110, RDX, TNT, and PETN. The explosive 114 may be configured to primarily to rupture the outer shell 110 and other solid parts of the munition 10 that surround the explosive 114, and secondarily to spread fragments 66 over a limited area. To that end, the explosive 114 may have a relatively low weight (mass) compared to that of the fragments 66. For example the weight ratio of fragments to explosive may be from 15:1 to 100:1, from 20:1 to 60:1, from 30:1 to 50:1, or about 40:1. The explosive 114 may be configured to spread the fragments 66 over a radius of from 1.5 meters (5 feet) to 4.6 meters (15 feet), or as much as 15 meters (50 feet), to give non-limiting examples.

In the illustrated embodiment the explosive 114 is shown as part of the insertable and removable cartridge 24. Alternatively the explosive 114 may be placed on its own within the canister 22, without being part of a cartridge or being readily removable.

An integral fuzewell 118 is located at an aft end of the cartridge 24. The fuzewell 118 is used to receive the fuze 94, which in turn is used for detonating the explosive 114. The fuzewell 118 may be integral in that it is fixedly attached to the outer shell 110 such that the fuzewell 118 may not be separated from the outer shell 110 without great effort and/or damage to the cartridge 24. A mounting bracket 120 is also located at the aft end of the cartridge 24, for mounting the cartridge 24 to the canister 22. The mounting bracket 120 may be formed along with the fuzewell 118 as a single piece. Alternatively the fuzewell 118 and the bracket 120 may be formed as separate pieces.

A conduit or tube 126 runs down the center (central longitudinal axis) of the cartridge 24, from the fuzewell 118 to the front end of the cartridge 24. The conduit 126 surrounds and defines an axial cartridge hole 130. At the front end of the cartridge 24 the cartridge hole 130 connects up with and is in communication with the canister hole 84. A radial cartridge hole 134 is in a radial direction through the explosive 114, extending from the tube 126 and open to the outside of the cartridge 24. The radial cartridge hole 134 aligns with the radial canister hole 86. The combination of the holes of the canister 22 and the cartridge 24 provides the connections described above between various parts of the munition 10, and/or between the munition 10 and the launcher and/or the nose kit 34 and/or the tail kit 38.

Figure 4:
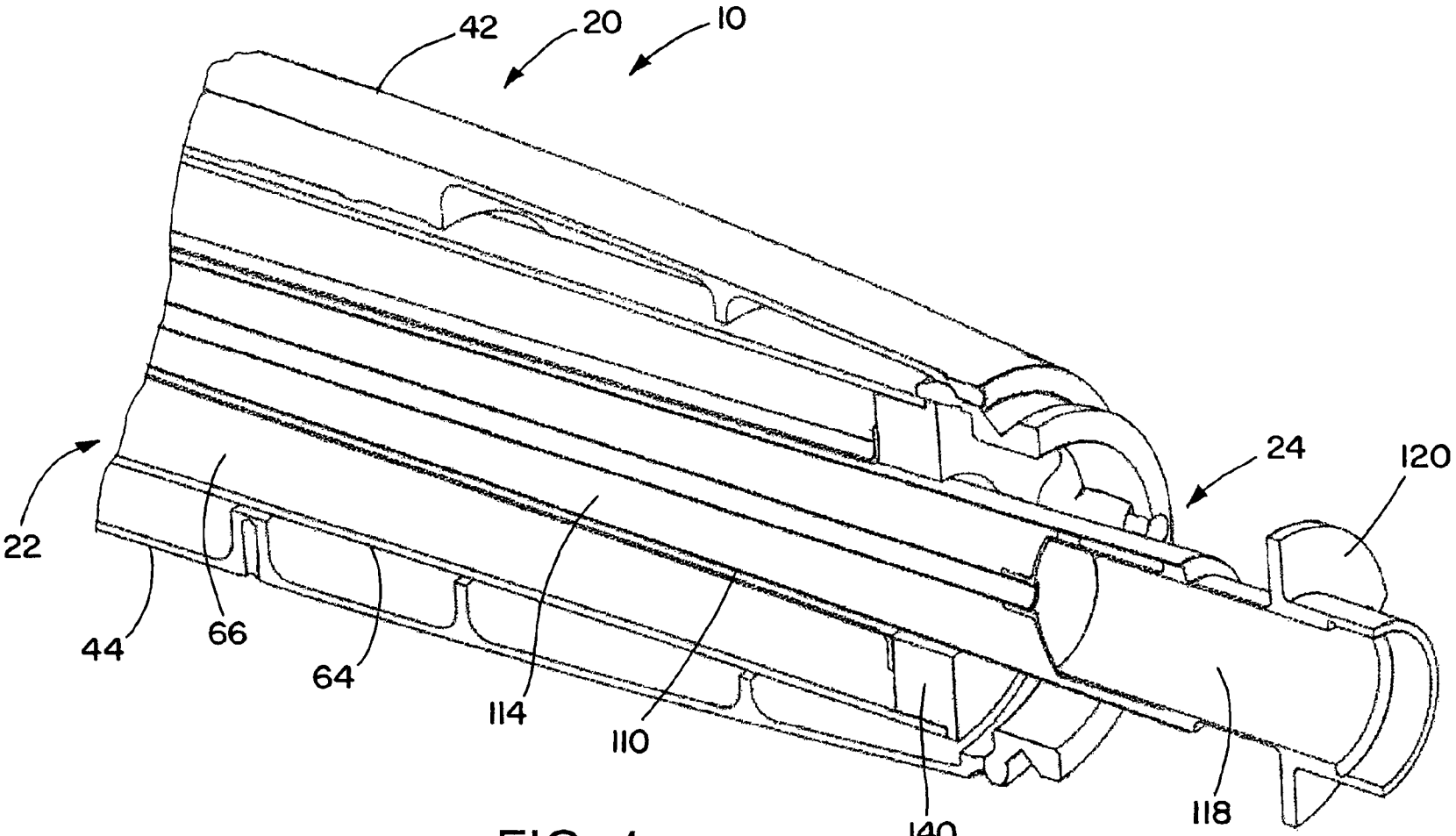
FIG. 4 is an oblique view, with parts in cross-section, of a portion of the munition of FIG. 1.

With reference now in addition to FIG. 4, the cartridge 24 is mechanically coupled to the canister 22 through use of a series of fasteners (not shown), such as bolts or other threaded fasteners, that clamp the mounting bracket 120 to an aft flange 140 of the canister 22. The patterns of the holes for the fasteners may be configured so that the cartridge 24 only can be secured to the canister 22 when the cartridge 24 is in the proper orientation, such as when the radial cartridge hole 134 (FIG. 3) aligns with the radial canister hole 86 (FIG. 3). The cartridge 24 may be easily inserted into the canister 22 by sliding the cartridge 24 into the canister central hole 80, and securing the cartridge 24 with the fasteners. Removal of the cartridge 24 is similarly easy, accomplished by removing the fasteners, and sliding the cartridge 24 out of the canister 22.

The cartridge 24 corresponds to the size and shape of the canister central hole 80. The cartridge 24 may have a nonuniform diameter, being relatively narrow (smaller diameter) at its front end, and relatively wider (larger diameter) at its aft or back end, where the fuzewell 118 is located. The nonuniform radius may facilitate installation and removal of the cartridge 24. In addition, the nonuniform thickness of the explosive 114 may provide improved performance of the munition 10, as discussed below, with the explosive force of the cartridge 24 varying along an axial direction of the cartridge 24. In the illustrated embodiment the cartridge 24 has a tapered shape, with the diameter of the cartridge 24 tapering down from an aft end that is wide enough to accommodate the fuzewell 118, to a relatively narrow nose (front end) that has a diameter that less than that of the fuzewell 118 (and less than that of the fuze 94). This tapering produces a frusto-conical shape for the cartridge 24. As a non-limiting example, the angle of the taper may be from 1 degree to 15 degrees.

Many alternative shapes with nonuniform thickness (diameter) are possible, some of which are discussed below. For example, parts of the cartridge may alternatively have a cylindrical shape, without taper, while other parts of the cartridge may have a tapered shape, and/or may have other variations of shape with variations of axial location, such as step changes in diameter. As a further alternative, the cartridge may be cylindrical, without any substantial change in its thickness (diameter) along its length.

Other alternative configurations are possible. For example, in the illustrated embodiment discussed above, the cartridge 24 fit into a hole at the aft end of the canister 22. Alternatively the cartridge may be placed in a hole in the nose (front) end of the canister, with the fuze for example at the front end, and the cartridge having a nonuniform diameter that is relatively small at its aft end (the end first inserted into the hole) and relatively large at its front end (the end closest to the opening of the canister hole when the cartridge is inserted).

The explosive 114 may fill most of the cartridge 24. For example, the explosive 114 may constitute a majority of the volume of the cartridge 24. At any given axial location forward of the fuzewell 118 and aft of the tip of the outer shell 110, the explosive 114 may constitute a majority of the cross-sectional area perpendicular to the axis of the cartridge 24.

Figure 5:
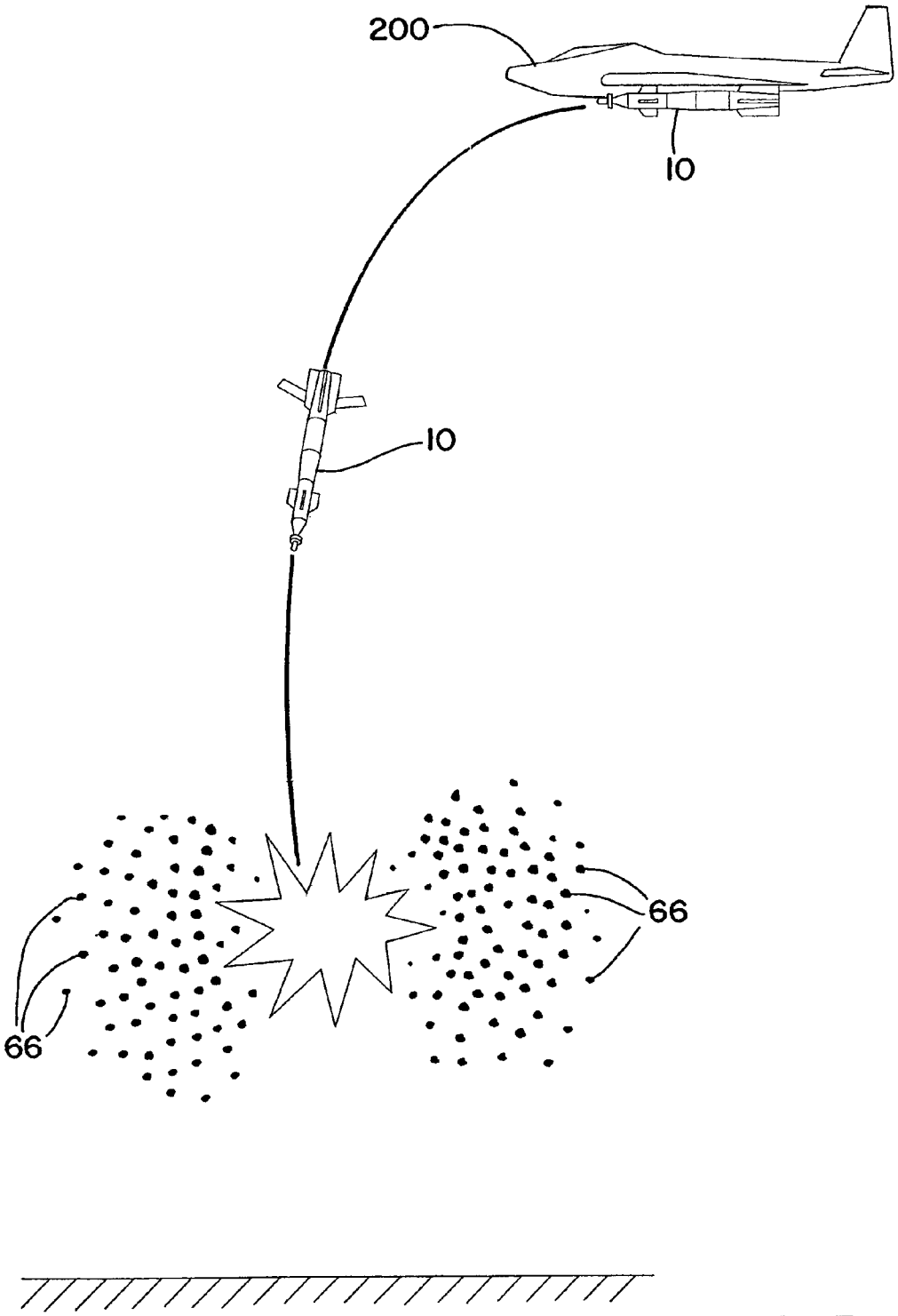
FIG. 5 is schematic view illustrating operation of the munition of FIG. 1.

FIG. 5 illustrates use of the munition 10 as a height-of-burst weapon. The munition 10 may be set to detonate the explosive 114 (FIG. 3) at a predetermined height above the ground, to spray fragments over a limited area, for example for use as an antipersonnel weapon. The height at which the munition 10 detonates may be set before launch of the munition 10, for example by communication from the launcher (an aircraft 200) to the munition 10 (e.g., the nose kit 34). One or more sensors in the munition 10 or in the nose kit 34 may be used to determine the height of the munition 10 above the ground after launch. When the desired height is reached, a signal is sent, for instance from the nose kit 34, to trigger the fuze 94 (FIG. 3) to detonate the explosive 114. This detonation can spread the fragments 66 over a desired area. The fragments 66 then descend toward the ground, impacting targets above ground level, at ground level, and/or below ground level. The munition 10 functions with a single detonation, initiated by triggering the fuze 94, in contrast to cluster munitions which have multiple detonations triggered separately at different times and/or in different locations.

The height of burst and the configuration of the munition 10 may be used to control the area over which the fragments 66 are spread. The explosive 114 may be used primarily to spread the fragments 66, with gravity providing kinetic energy to the fragments 66 as the fragments 66 fall, increasing the damage-causing potential of the fragments 66. For example, the height of burst may be very close to the ground, for example at a height of 20 meters or less, or more narrowly at a height of 10 meters or less or 5 meters of less. The explosive 114 may be configures to spread the fragments 66 a limited distance when such a height of burst is employed, for example radially spreading the fragments 66 a distance of 10 meters or less, 5 meters or less, or over a radius of from 1.5 meters (5 feet) to 4.6 meters (15 feet), to give a few examples. For example, a height of burst of 2 meters may produce a fragment pattern that covers an area over a radius of 3 meters (10 feet), with virtually no damage beyond a radius of 4.6 meters (15 feet).

The spread of the fragments 66 is a function of the height of burst (among other variables). Therefore by setting a height of burst, such as before release of the munition 10, the area over which the fragments 66 are spread may be controlled. This allows the munition 10 to be tailored in use to control the area that it affects, avoiding collateral damage to nearby objects that are not intended targets.

Figure 6:
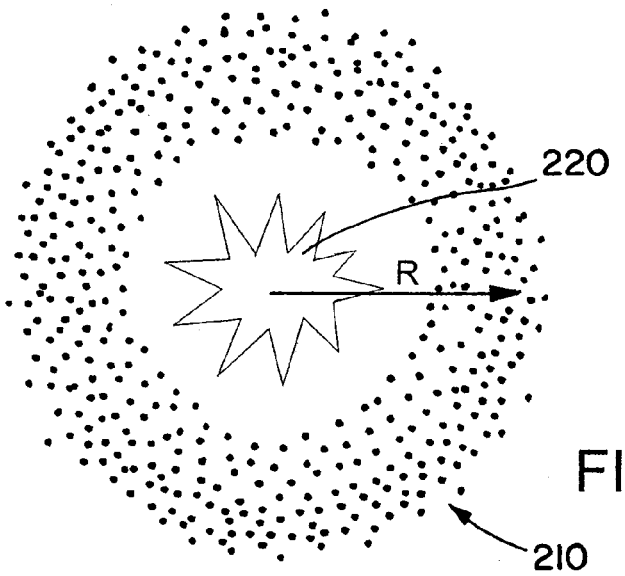
FIG. 6 is a plan view schematically illustrating a spread of fragments from a munition having explosive force that is constant in an axial direction.
Figure 7:
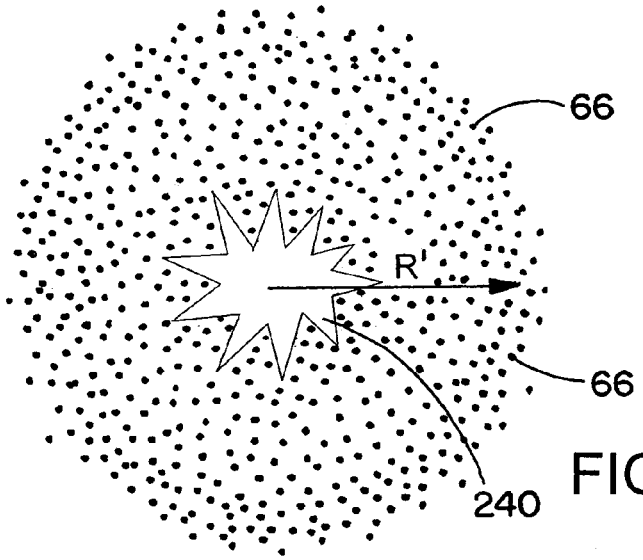
FIG. 7 is a plan view schematically illustrating a spread of fragments from the munition of FIG. 1.
Figure 8:
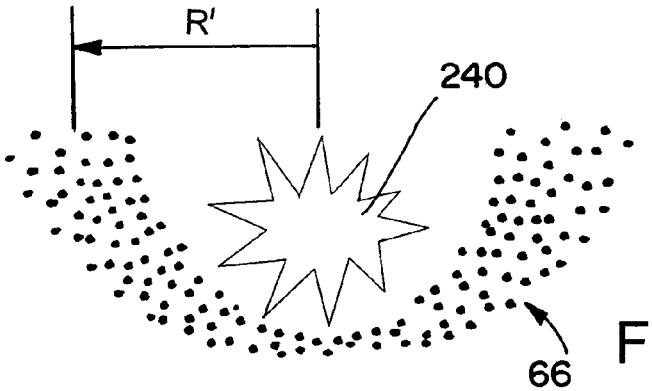
FIG. 8 is a side view of the spread of fragments of FIG. 7.

Turning now to FIGS. 6-8, the axial variation in explosive force of the cartridge 24 may provide a more desirable spread of the fragments 66. FIG. 6 is a view from above that shows an example of the spread of substantially-identical fragments 210 that occurs from detonation of a munition having a constant explosive force for spreading the fragments 210, with the detonation occurring at location 220. The pattern is circular (annular), with the concentration of the fragments 210 centered over a given radius R, corresponding to the explosive force that each of the fragments 210 receives when the explosive is detonated. In a three-dimensional view, the spread shown in FIG. 6 would correspond to a hollow cylindrical shell, with a thickness corresponding to the range of radii where the largest concentration of fragments is located.

FIGS. 7 and 8 show top and side views of the spread of the fragments 66 from the munition 10 (FIG. 1), a munition in which the explosive force of the cartridge 24 (FIG. 3) varies along its axial direction. In the illustrated situation, the munition 10 has been detonated at location 240, after descending in a vertical direction (in a nose-down condition). In the munition 10 the explosive 114 (FIG. 3) is narrowest at the nose, and gradually increases in thickness further back axially along the length of the cartridge 24. For a uniform explosive material, this produces a smallest explosive force for the fragments 66 that are nearest the nose, propelling those fragments the smallest distance away from the detonation location 240. Farther back along the munition the fragments 66 receive greater and greater amounts of explosive force (from thicker and thicker cross-sections of explosive material), propelling the corresponding fragments 66 greater and greater distances from the detonation location 240. The result is a conical spread of the fragments 66 (more accurately, the spread has the shape of a hollow frusto-conical body, with the thickness of the body corresponding to the region of highest concentration of the fragments 66). In a top view, such as shown in FIG. 7, the spread of the fragments 66 appears as an annular region centered about a radius R', with the thickness of the annular region greatly increased relative to that shown in FIG. 6. With the spread of the fragments 66 increased, the munition 10 covers a greater area, relative to the situation illustrated in FIG. 6, providing a more effective area munition. It will be understood that the explosive 114 may be configured to achieve a desired spreading of the fragments 66, achieving spreading over as wide an area as desired, while avoiding spreading beyond an intended target area.

The comparison made in FIGS. 6-8 is a qualitative comparison, showing how the use of axial variations in explosive force may result in increased spread of fragments. It will be understood that other factors may affect the spread of fragments, including use of fragments of different sizes and/or geometries, and detonation with the munition at a nonzero angle relative to vertical, to give a few examples.

Use of the munition 10 may provide several advantages over prior configurations. The cartridge 24 is initially separated from the rest of the munition 10, which allows the munition 10 to be transported and stored more safely, with a reduced hazard classification relative to munitions carrying explosive materials. The munition 10 may be made operational only shortly before use. The cartridge 24 is also removable from the rest of munition 10, which facilitates deactivation of the munition 10, and allows for easier and more efficient disposal of the parts of a deactivated munition. The variation of explosive force in different parts of the cartridge 24 makes the munition 10 more effective as an area weapon by spreading the fragments 66 more uniformly over a target area. Finally, the modularity of the munition 10, with the cartridge 24 separable from the canister 22, enables the possibility of using different cartridges 24 and/or different canisters 22, in different combinations, to achieve different effects upon detonation.

Figure 9:
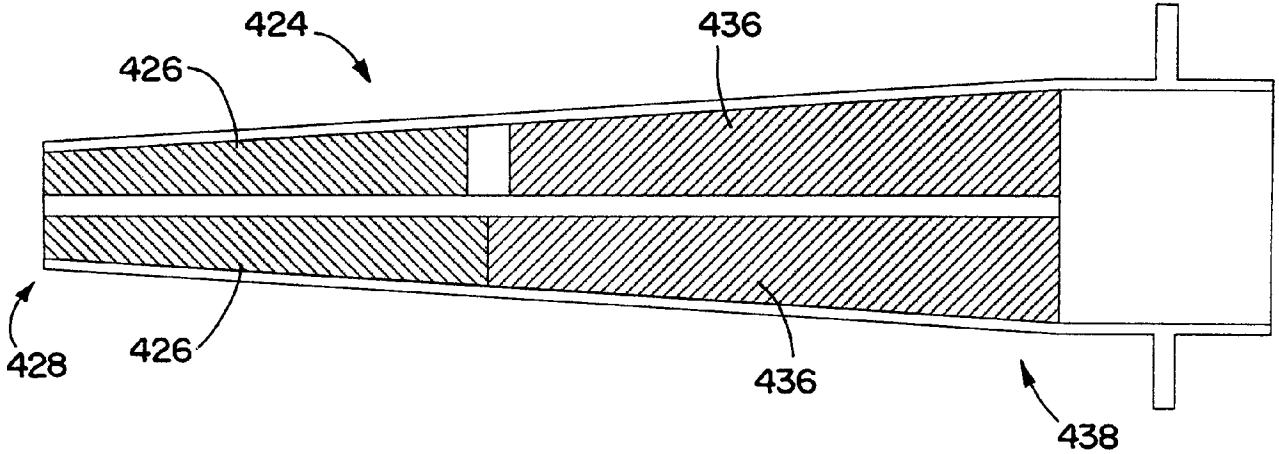
FIG. 9 is a side sectional view of an explosive cartridge according to a first alternate embodiment of the present invention, an alternative to the explosive cartridge of the munition of FIG. 1.

FIG. 9 shows an alternative cartridge 424 that may be used in place of the cartridge 24 (FIG. 3). While the cartridge 24 has only a single type of explosive, the cartridge 424 has multiple types of explosives, for example having a first explosive 426 in a nose region 428, and a second explosive 436 in a tail region 438. Other details of the cartridge 424 may be similar to those of the cartridge 24. The explosives 426 and 436 may have different characteristics, for example providing different amounts of explosive force. Many alternative arrangements for different explosives within the same cartridge are possible. The different explosives may be in different axial locations within the cartridge, as is shown in FIG. 9. Alternatively or in additions, the different explosives may be in different radial locations, with one explosive surrounding or overlapping all or part of another explosive, for example. In addition, three or more different explosives may be used, if desired. The use of different explosives allows for more options in configuring a cartridge to achieve a desired dispersal of fragments. Also, a non-explosive material may be included within the volume enclosed by the casing, either in addition to or as a substitute for one of the explosives 426 and 436, to provide further possibilities for varying the explosive force at different locations within the cartridge 624. As another alternative, an annular tapered conical sleeve could be situated between the explosive cartridge and the fragmentation canister. Such a sleeve could one of a number of possible sleeves to be inserted, for example with an inert material or different types of explosive material, for example to achieve varying degrees of dispersion of the fragments.

Figure 10:
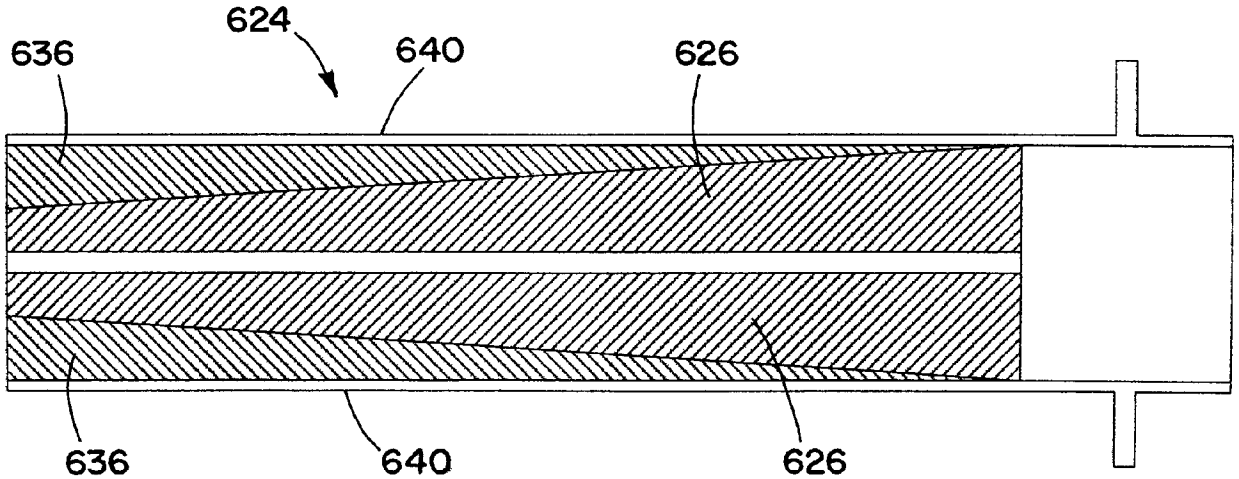
FIG. 10 is a side sectional view of an explosive cartridge according to a second alternate embodiment of the present invention, an alternative to the explosive cartridge of the munition of FIG. 1.

FIG. 10 shows another alternative, a cartridge 624 having a cylindrical shape, with a first explosive 626 surrounded by a second explosive 636, within a casing 640. The cylindrical shape may have a substantially-constant diameter, for example varying 1% or less in the axial direction. The explosives 626 and 636 have different explosive forces (for example releasing different amounts of energy per unit volume or mass), and vary in relative amounts in the axial direction of the cartridge 624. This results in the cartridge 624 having a distribution of explosive force that varies in the axial direction, despite the cartridge 624 having substantially the same diameter along its length. In the illustrated embodiments the explosives 626 and 636 have relative amounts that vary linearly over the length of the cartridge 624, but many alternative arrangements are possible for providing nonuniformity in relative amounts of two or more different types of explosives. In addition, the configuration in FIG. 10 may alternatively include only a single explosive, with the resulting cartridge having a uniform explosive force (not varying in the axial direction), but still having the advantage of modularity.

Figure 11:
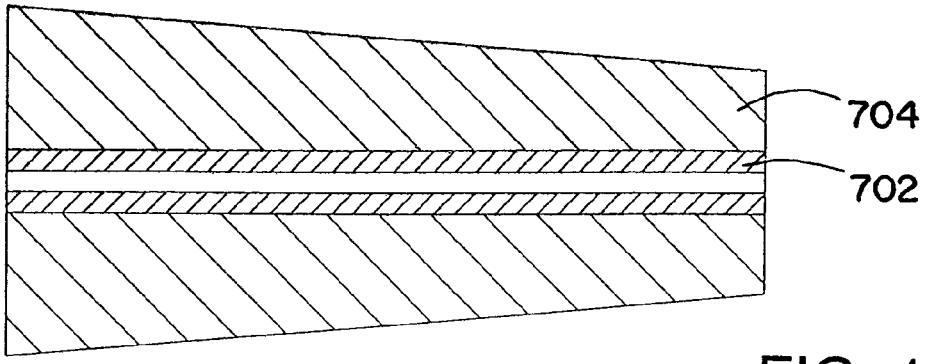
FIG. 11 is a side sectional view of an explosive layer and a fragmentation layer according to a third alternate embodiment of the present invention.
Figure 12:
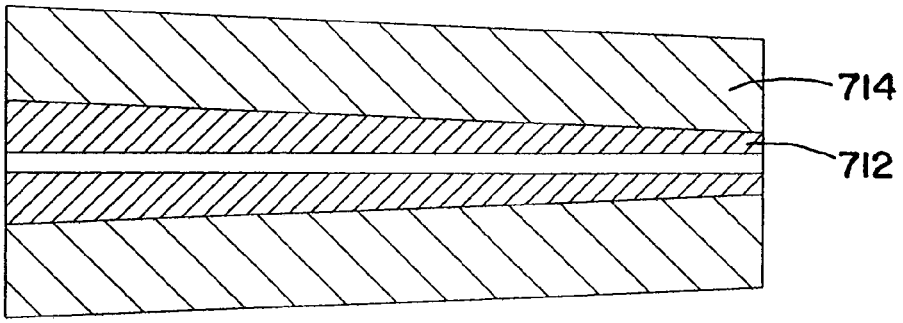
FIG. 12 is a side sectional view of an explosive layer and a fragmentation layer according to a fourth alternate embodiment of the present invention.
Figure 13:
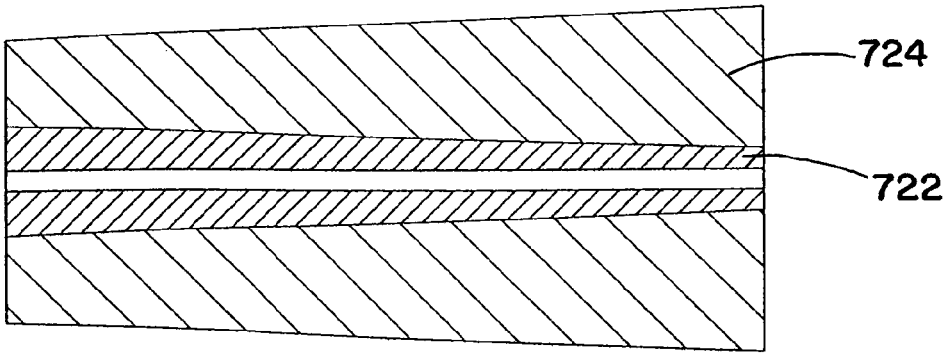
FIG. 13 is a side sectional view of an explosive layer and a fragmentation layer according to a fifth alternate embodiment of the present invention.

Another possibility, alone or in combination with other features described above, is to vary in the axial direction the combined thickness of the explosive (for example in a cartridge) and the fragmentation layer (for example in a canister surrounding the cartridge), in any of various ways. FIG. 11 shows one alternative, with a constant-thickness explosive layer 702 surrounded by a varying-thickness fragmentation layer 704. FIG. 12 shows another alternative, with a varying-thickness explosive layer 712 surrounded by a constant-thickness fragmentation layer 714. A third alternative is shown in FIG. 13, with both an explosive layer 722 and a fragmentation layer 724 varying in thickness in the axial direction. The thicknesses can vary opposite one another, as in the illustrated embodiment with the explosive layer 722 relatively thicker as the fragmentation layer becomes relatively thinner. Alternatively the thicknesses may vary in the same direction, both becoming relatively thicker or relatively thinner at the same time. In addition, the embodiments illustrated in FIGS. 11-13 show simple linear changes in thickness, but other nonlinear thickness changes are possible.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A fragmentation munition comprising:

a fragmentation canister containing preformed fragments; and an explosive in a central hole in the fragmentation canister;

wherein a weight ratio of the fragments to the explosive is from 15:1 to 100:1;

wherein the explosive is part of a removable explosive cartridge inserted in the central hole;

wherein the explosive cartridge includes:

an outer shell; and the explosive within the outer shell;

wherein the cartridge includes an integral fuzewell at an aft end of the cartridge;

wherein at least some of the preformed fragments surround the explosive and the central hole; and wherein the fragmentation canister includes a casing surrounding the preformed fragments, with the at least some of the preformed fragments packed into the casing between the casing and the central hole; and further comprising an airframe that surrounds the canister and the cartridge.

2. The munition of claim 1, wherein the explosive cartridge has a relatively small diameter at a first end of the cartridge that is first inserted into the central hole, and a relatively large diameter, larger than the relatively small diameter, at a second end of the cartridge that is opposite the first end.

3. The munition of claim 2, wherein the explosive cartridge has a tapered shape, tapering from the relatively small diameter to the relatively large diameter.

4. The munition of claim 3, wherein the explosive also has a tapered shape that changes diameter with changes in axial location.

5. The munition of claim 1, wherein the cartridge includes a conduit running axially through the explosive.

6. The munition of claim 5, wherein the conduit is in communication with an aligned conduit that is part of the canister, with the aligned conduit extending in a radial direction through the casing.

7. The munition of claim 5, wherein the conduit is in communication a radial conduit hole through the explosive and the outer shell.

8. The munition of claim 7, wherein the radial conduit hole is aligned with a radial canister hole through the canister.

9. The munition of claim 1, wherein explosive force of the explosive varies with axial location along the explosive cartridge.

10. The munition of claim 9, wherein variation in the explosive force is due at least in part to variations in amount of the explosive at different axial locations.

11. The munition of claim 9, wherein variation in the explosive force is due at least in part to variations in composition of the explosive at different axial locations.

12. The munition of claim 9, wherein, upon detonation of the explosive, different of the fragments are dispersed different distances from the munition, with fragments subject to relatively large explosive force being dispersed farther than fragments subject to relatively small explosive force that is less than the relatively large explosive force.

13. The munition of claim 1, wherein the weight ratio of the fragments to the explosive is from 20:1 to 60:1.

14. The munition of claim 1, wherein the weight ratio of the fragments to the explosive is from 30:1 to 50:1.

* * * * *